US007070468B2

(12) United States Patent
Schmidt

(10) Patent No.: US 7,070,468 B2
(45) Date of Patent: Jul. 4, 2006

(54) MULTI-HULL WATERCRAFT WITH AMIDSHIPS-MOUNTED PROPELLERS

(75) Inventor: Terrence W. Schmidt, Santa Clara, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/883,058

(22) Filed: Jul. 1, 2004

(65) Prior Publication Data

US 2006/0000398 A1 Jan. 5, 2006

(51) Int. Cl.
*B63H 5/07* (2006.01)

(52) U.S. Cl. ..... 440/79; 114/61.12; 114/265

(58) Field of Classification Search ..... 440/5, 440/6, 80, 21, 79, 83, 67, 78, 54, 3, 26, 81; 114/59, 61.1–61.22, 151, 265, 57, 123
See application file for complete search history.

(56) References Cited

U.S. PATENT DOCUMENTS 803,768 A * 11/1905 Lockwood ..... 440/90
1,161,453 A * 11/1915 Court ..... 440/68
1,545,723 A * 7/1925 Louis ..... 440/48
1,703,722 A * 2/1929 Augusto ..... 440/80
1,757,174 A * 5/1930 Douglas ..... 114/61.13
1,861,338 A * 5/1932 Faust ..... 114/61.14
2,393,234 A * 1/1946 Starling ..... 114/163
2,692,570 A * 10/1954 William ..... 114/77 A
3,584,593 A * 6/1971 Blount ..... 440/75
5,947,779 A * 9/1999 Heideman et al. ..... 440/6

* cited by examiner

*Primary Examiner*—Ed Swinehart
(74) *Attorney, Agent, or Firm*—DeMont & Breyer, LLC

(57) ABSTRACT

An efficient double-ended watercraft is disclosed that comprises four low-Froude number hulls: two forward, two aft, two on the port side, and two on the starboard. Each hull comprises an independent engine that drives a propeller shaft and propeller that is located amidships. The propeller shafts on the starboard are collinear, as are the propeller shafts on the port. The propellers on the starboard are near each other and counter rotate, as do the propellers on the port. The propellers are variable-pitch propellers. When the ferry is changes from moving forward to moving in reverse and from reverse to forward, the propellers on the starboard exchange pitch. This enables the ferry to move as efficiently in reverse as it does when forward. The propellers on the port also exchange pitch when changing from moving forward to moving in reverse and from reverse to forward.

8 Claims, 6 Drawing Sheets

MULTI-HULL WATERCRAFT WITH AMIDSHIPS-MOUNTED PROPELLERS

FIELD OF THE INVENTION

The present invention relates to naval architecture in general, and, more particularly, to double-ended watercraft.

BACKGROUND OF THE INVENTION

Ferries, roll-on/roll-off and other "double-ended" watercraft (i.e., watercraft that often travel in both forward and reverse) require propulsion systems that are efficient for travel in both forward and reverse. In accordance with one technique in the prior art, propulsors (e.g., waterjets, propellers, etc.) on azipods are located at both ends of a double-ended vessel and rotate around a vertical axis so that they point in the desired direction of travel. This technique is disadvantageous, however, because the equipment used to hold and rotate the azipods is heavy, bulky, expensive, and prone to malfunction.

Therefore, the need exists for an improved double-ended watercraft design that avoids this disadvantage.

SUMMARY OF THE INVENTION

The present invention is particularly well-suited with double-ended watercraft and avoids some of the costs and disadvantages associated with double-ended watercraft in the prior art. Although the illustrative embodiment of the present invention is a double-ended watercraft, it will be clear to those skilled in the art, after reading this specification, how to make and use embodiments of the present invention in other watercraft and machines, such as aircraft, windmills, and axial impellers for ventilation and other air handling applications such as wind tunnels.

The illustrative embodiment is a double-ended ferry that comprises four high-Froude number hulls: two forward, two aft, two on the port side, and two on the starboard. The ferry's hulls exhibits longitudinal and lateral symmetry and provide equally efficient propulsion in both forward and reverse.

Each hull comprises an independent engine and gearbox that drives a propeller shaft and propeller that is located amidships. Mounting the propellers amidships is advantageous because it reduces the propellers vulnerability to ice, grounding in shallow water, and other impediments.

The propeller shafts on the starboard are collinear, as are the propeller shafts on the port. The propellers on the starboard oppose each other and counter rotate, as do the propellers on the port, and form a counter-rotating propeller system. This affords the advantages of a counter-rotating propeller system without the disadvantage of counter-rotating propeller systems in the prior art (e.g., counter-rotating concentric shafts, complex gear boxes, etc.). Having two independent engines/gearboxes/propeller shafts/shafts on both the port and starboard also provides redundancy, which makes the craft fault-tolerant.

In accordance with the illustrative embodiment, the propellers are variable-pitch propellers. When the ferry changes from moving forward to moving in reverse and from reverse to forward, the pitch and the direction of rotation of each propeller changes. This enables the ferry to move as efficiently in reverse as it does when forward.

The illustrative embodiment comprises: a first hull; a second hull; a first propeller shaft that extends from the first hull towards the second hull; and a second propeller shaft that extends from the second hull towards the first hull.

DETAILED DESCRIPTION

Figure 1:
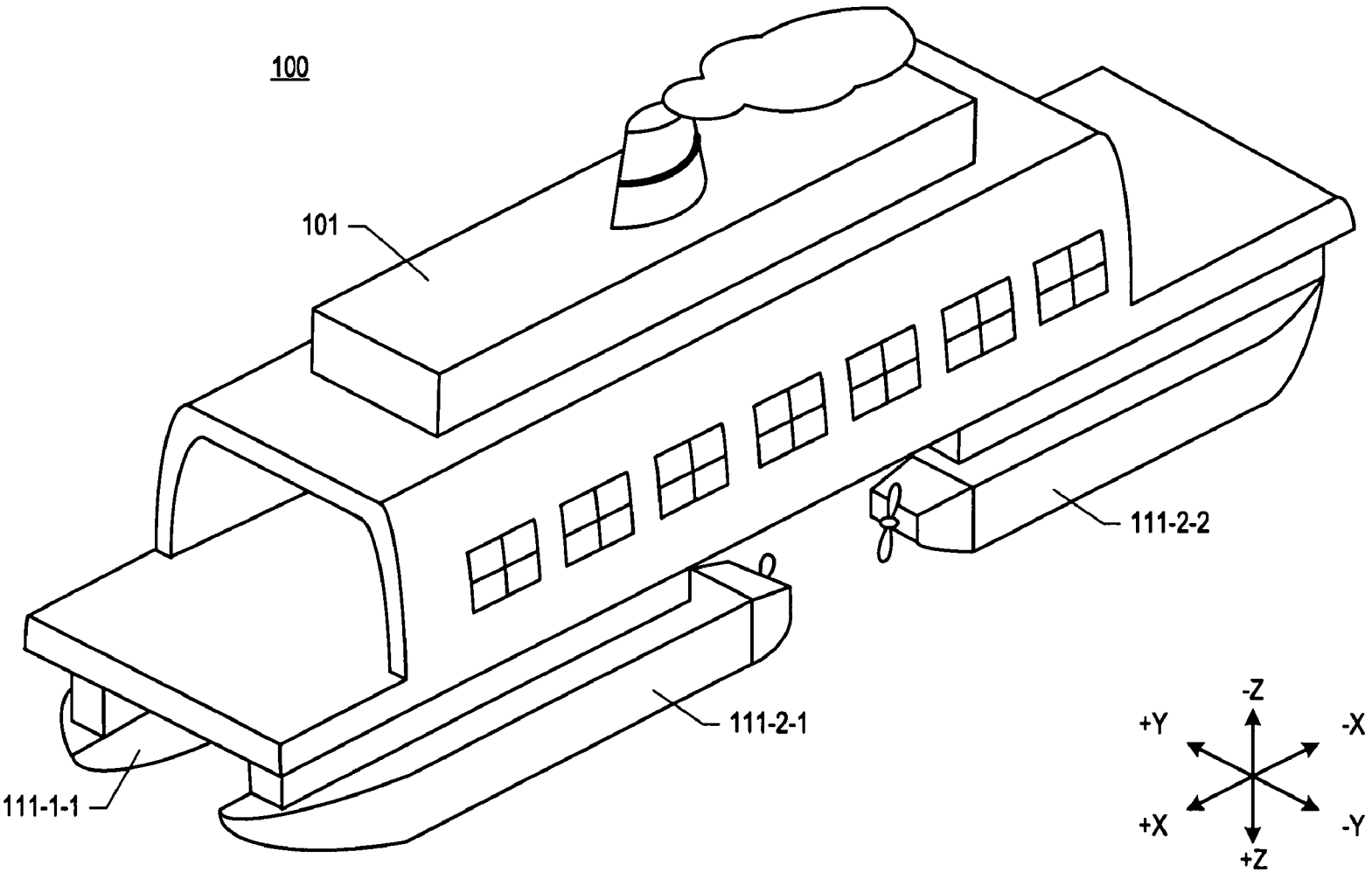
FIG. 1 depicts an isometric drawing of the salient components of the illustrative embodiment of the present invention.
Figure 2:
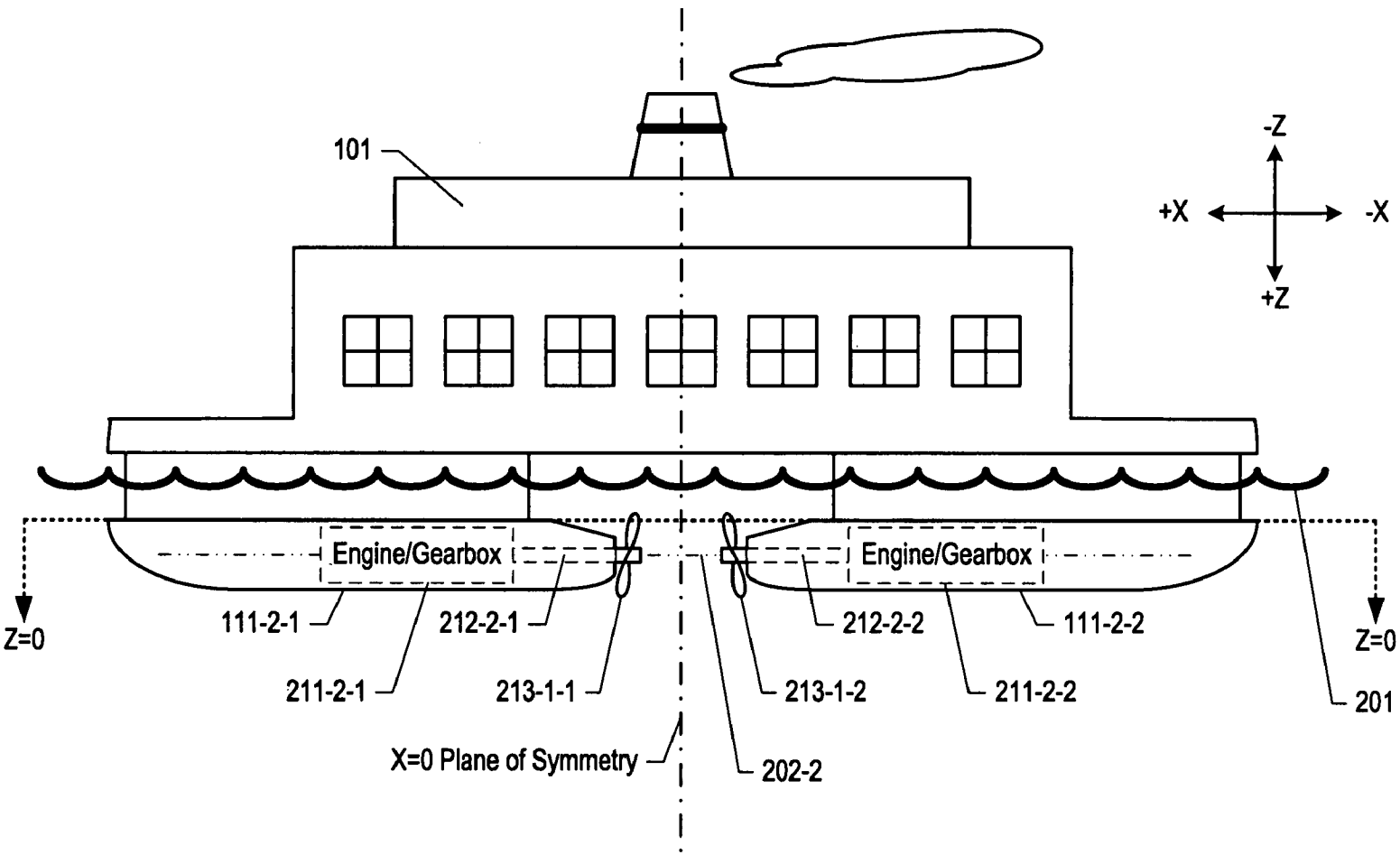
FIG. 2 depicts a side view of the salient components of the illustrative embodiment of the present invention.
Figure 3:
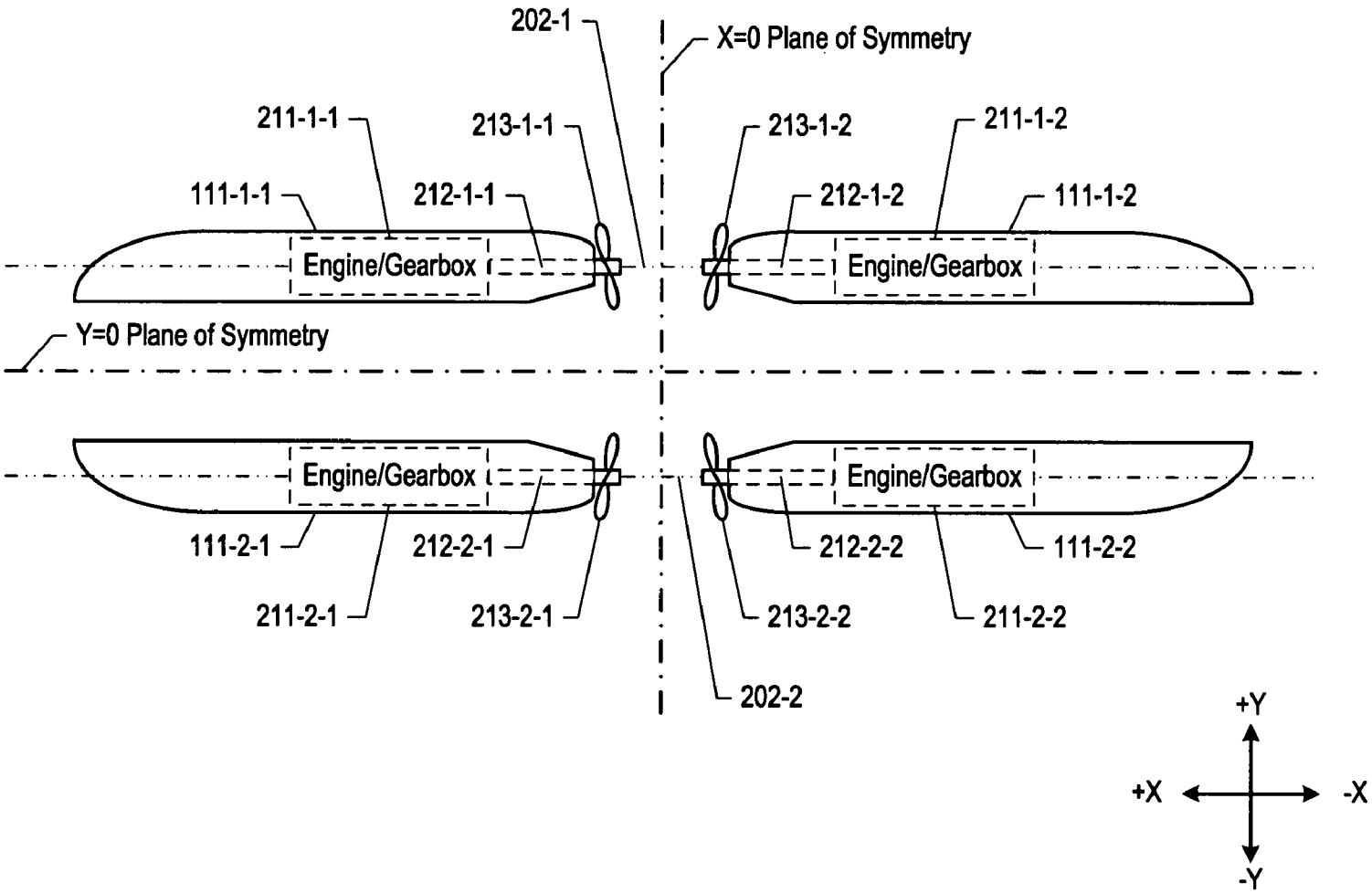
FIG. 3 depicts a plan view drawing—taken at elevation YY—of ferry 100, as depicted in FIG. 2.

FIG. 1 depicts an isometric drawing and FIG. 2 depicts a side view drawing of the salient components of the illustrative embodiment of the present invention, ferry 100. FIG. 3 depicts a plan view drawing—taken at elevation Z=0—of ferry 100, as depicted in FIG. 2.

Ferry 100 comprises:

superstructure 101, four (4) hulls: hull 111-1-1, hull 111-2-1, hull 111-1-2, and hull 111-2-2;

four (4) engines and gearboxes: engine/gearbox 211-1-1, engine/gearbox 211-2-1, engine/gearbox 211-1-2, and engine/gearbox 211-2-2, four (4) propeller shafts: propeller shaft 212-1-1, propeller shaft 212-2-1, propeller shaft 212-1-2, and propeller shaft 212-2-2, and four (4) propellers: propeller 213-1-1, propeller 213-2-1, propeller 213-1-2, and propeller 213-2-2, interconnected as depicted in FIGS. 1, 2, and 3. Although the illustrative embodiment comprises four sets of hulls/engines/gearboxes/propeller shafts/propellers, it will be clear to those skilled in the art, after reading this disclosure, how to make and use embodiments of the present invention that comprises two or more sets of hulls/engines/gearboxes/propeller shafts/propellers.

Ferry 100 is a double-ended watercraft that is capable of loading and unloading passengers, cargo, and vehicles from the bow as easily as from the stern, and of being driven bow first as easily and efficiently as being driven stern first. Except for the pitch of the propellers, ferry 100 exhibits longitudinal symmetry (i.e., is symmetrical about plane X=0, as shown in FIGS. 2 and 3), and lateral symmetry (i.e., is symmetrical about plane Y=0, as shown in FIG. 3).

Because of the longitudinal symmetry, the designation of bow and stern are arbitrary. In accordance with the illustrative embodiment, the end of ferry 100 nearest hulls 111-1-1 and 111-2-1 is designated as the bow.

Hulls 111*x*-1 (wherein x is chosen from the set of integers {1, 2}), engines/gearboxes 211*x*-1, propeller shafts 212*x*-1, and propellers 213*x*-1 are associated with the bow of ferry 100, while hulls 111*x*-2, engines/gearboxes 211*x*-2, propeller shafts 212*x*-2, and propellers 213*x*-2 are associated with the stern of ferry 100. Similarly, hulls 111-1-x, engines/gearboxes 211-1-x, propeller shafts 212-1-x, and propellers

213-1-x are on the starboard of ferry 100, while hulls 111-2-x, engines/gearboxes 211-2-x, propeller shafts 212-2-x, and propellers 213-2-x are on the port.

Superstructure 100 is a free-standing composite metal structure that houses the passengers, cargo, crew, and equipment for piloting ferry 100. Superstructure 100 rides above waterline 201 (shown in FIG. 2) atop the four hulls and provides the structural support necessary to keep the relative position and orientation of the hulls fixed. As shown in FIG. 2, the lower portion of hulls 111-1-1, 111-2-1, 111-1-2, and 111-2-2 are completely submerged. It will be clear to those skilled in the art how to make and use superstructure 100.

Each of the four hulls comprises an independently-controlled engine/gearbox that turns a propeller shaft that extends from that hull towards the other hull on the same side of ferry 100. For example, propeller shaft 212-2-1 extends from hull 111-2-1 towards hull 111-2-2, and conversely propeller shaft 212-2-2 extends from hull 111-2-2 towards hull 111-2-1. As shown in FIGS. 2 and 3, propeller shaft 212-1-1 is collinear with propeller shaft 212-1-2 along line 202-1, and propeller shaft 212-2-1 is collinear with propeller shaft 212-2-2 along line 202-2.

In normal operation, propeller shaft 212-1-1 counter-rotates with respect to propeller shaft 212-1-2, and propeller shaft 212-2-1 counter-rotates with respect to propeller shaft 212-2-2. In particular, when propeller shaft 212-2-1 turns with a rate of rotation of +ω, propeller shaft 212-2-2 turns with a rate of rotation of −ω (i.e., the two shafts turn at the same number of revolutions per minute but in opposite directions).

Figure 4:
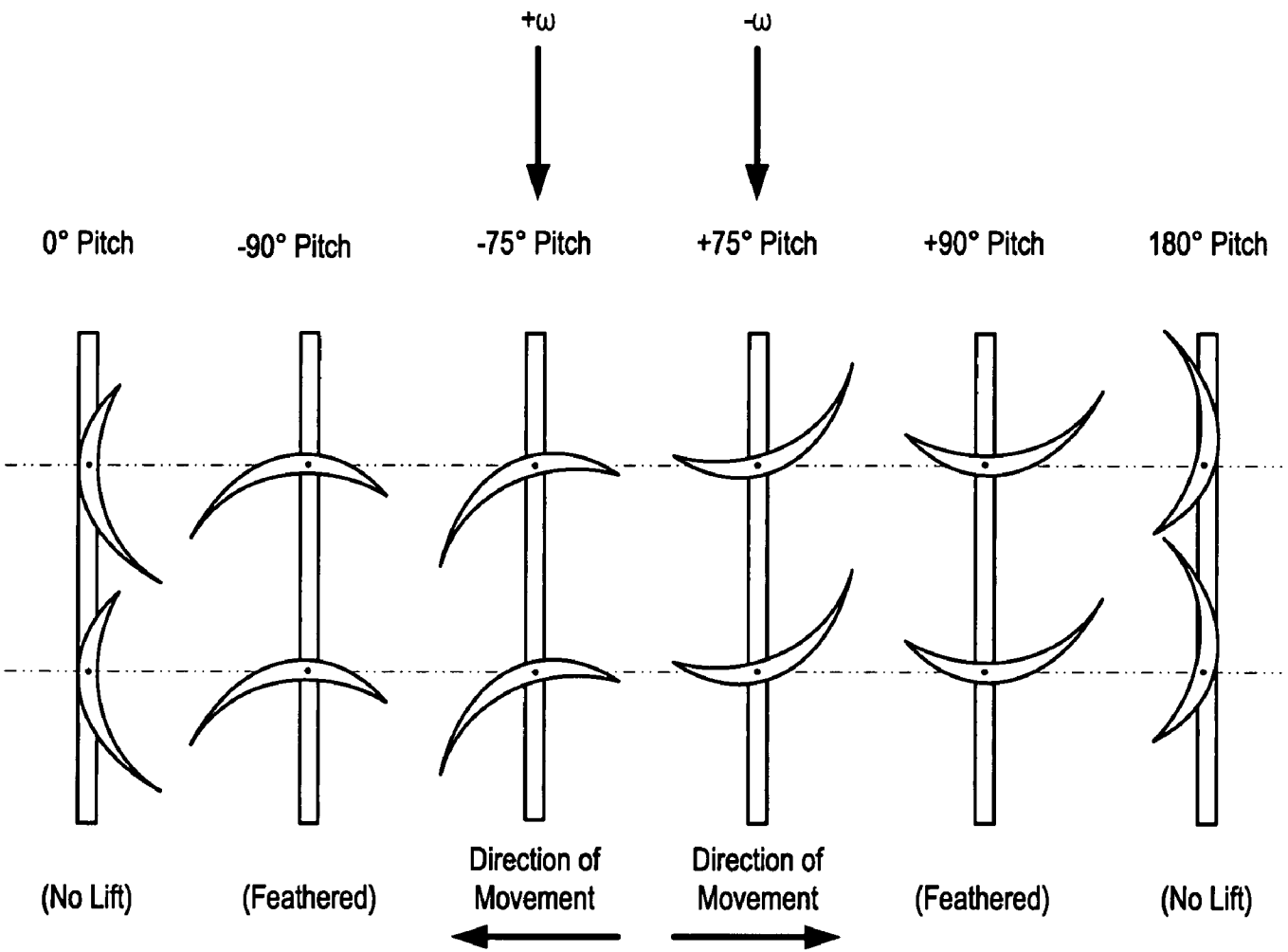
FIG. 4 depicts variable-pitch propeller 213*x*-1 at six different pitches (for a given diameter).

Each of propellers 213-1-1, 213-2-1, 213-1-2, and 213-2-2 is a variable-pitch propeller whose blades can be changed from −90° to +180°, in well-known fashion. FIG. 4 depicts variable-pitch propeller 213*x*-1 at six different pitches (for a given diameter). When the pitch of a propeller is set to −75° and the direction of rotation is +ω, then the direction of movement is towards the left. In contrast, when the pitch the propeller is set to +75° and the direction of rotation is −ω, then the direction of movement is towards the right. It will be clear to those skilled in the art how to make and use variable-pitch propellers.

Figure 5:
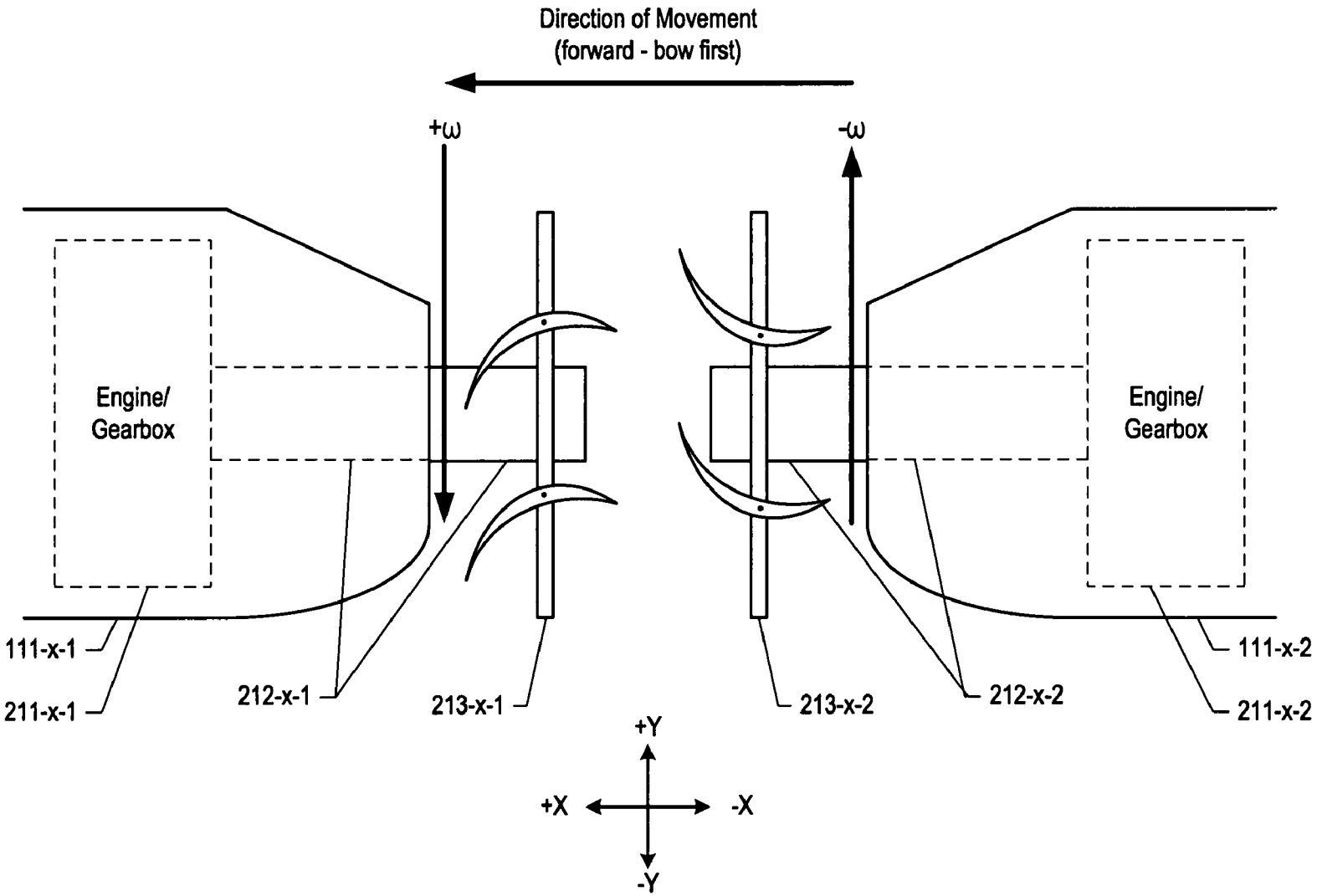
FIG. 5 depicts a plan-view diagram that focuses on the pitch and direction of rotation of propellers 213*x*-1 and 213*x*-2 when ferry 100 is moving forward (i.e., bow first).
Figure 6:
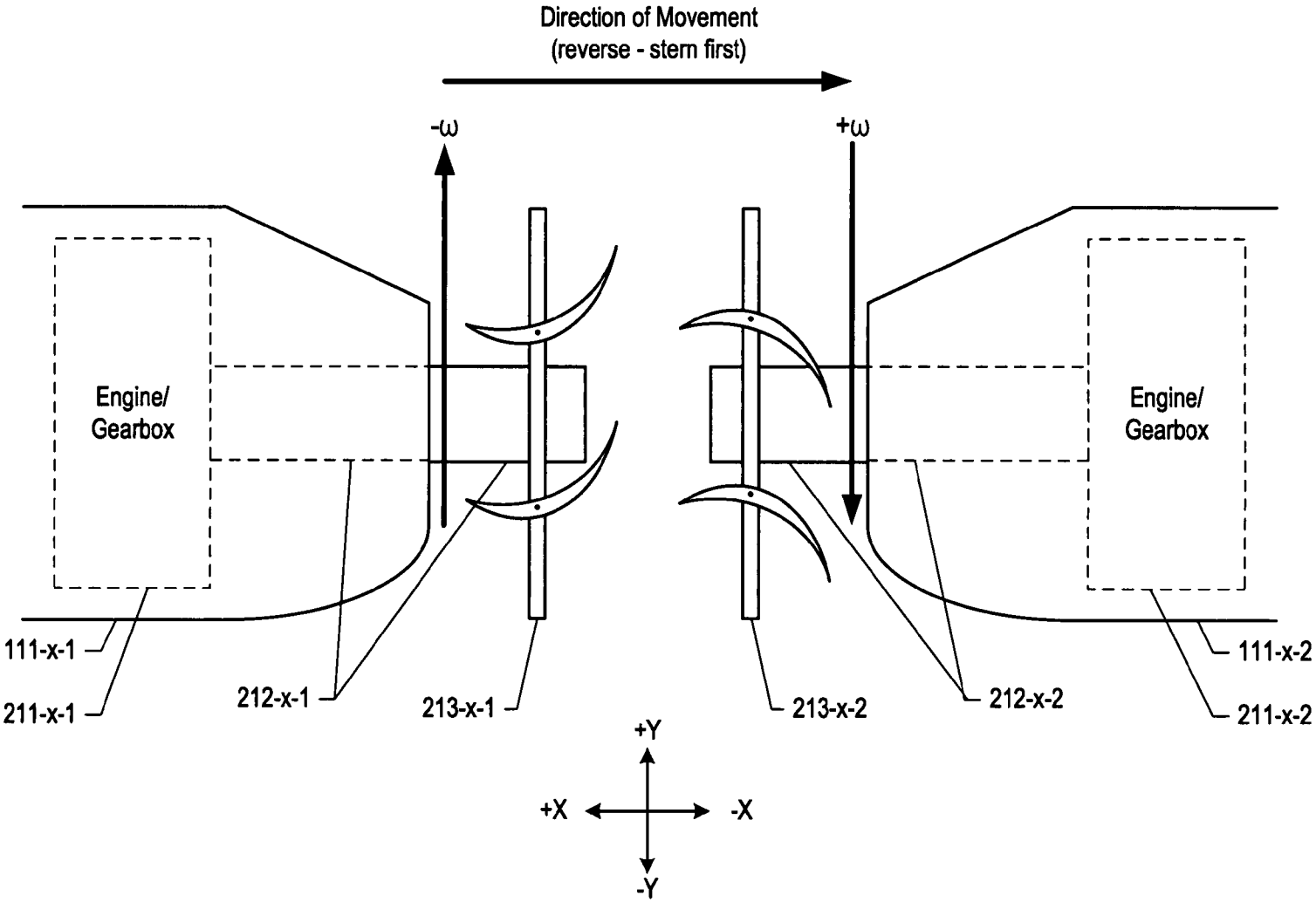
FIG. 6 depicts a plan-view diagram that focuses on the pitch and direction of rotation of propellers 213*x*-1 and 213*x*-2.

FIG. 5 depicts a plan-view diagram that focuses on the pitch and direction of rotation of propellers 213*x*-1 and 213*x*-2 when ferry 100 is moving forward (i.e., bow first), and FIG. 6 depicts a plan-view diagram that focuses on the pitch and direction of rotation of propellers 213*x*-1 and 213*x*-2 when ferry 100 is moving in reverse (i.e., stern first). Table 1 depicts the rate and direction of rotation, and blade pitch for each of the four propellers on ferry 100 when ferry 100 is moving forward.

TABLE 1

Rate and Direction of Rotation and Pitch for Propellers When Moving Forward.

| Propeller | Rate and Direction of Rotation | Pitch |
|---|---|---|
| 213-1-1 | $+\omega_S$ | $\phi_L$ |
| 213-1-2 | $-\omega_S$ | $\phi_T$ |
| 213-2-1 | $-\omega_P$ | $\phi_L$ |
| 213-2-2 | $+\omega_P$ | $\phi_T$ |

The value $\omega_S$ represents the rate of rotation on the starboard, and the value $\omega_P$ represents the rate of rotation on the port. The two values are opposite when ferry 100 is traveling in a straight line—forward or in reverse—but the values are different when ferry 100 is turning at very slow speed. It will be clear to those skilled in the art, after reading this specification, how to determine the appropriate values for $\omega_s$ and $\omega_P$ in any circumstance.

The value $\phi_L$ represents the pitch of a propeller when it is the leading propeller (i.e., the first propeller in the flow), and the value $\phi_T$ represents the pitch of a propeller when it is the trailing propeller (i.e., the second propeller in the flow). It should be understood that the designations of leading propeller and trailing propeller are not permanent, but are only in relation to the direction that ferry 100 is traveling. In accordance with the illustrative embodiment, $$\phi_T = -\phi_L \quad \text{(Eq. 1)}$$

In some alternative embodiments of the present invention, the pitch of the trailing propeller, $\phi_T$, is slightly different than the pitch of the leading propeller, $\phi_L$, $$\phi_T \approx -\phi_L \quad \text{(Eq. 2)}$$

because a set of counter-rotating propellers is most efficient when the pitch of trailing propeller is slightly different than the pitch of the leading propeller. In either case, it will be clear to those skilled in the art, however, how to make and use embodiments of the present invention in which the propellers have the same or different pitch.

Table 2 depicts the rate and direction of rotation, and blade pitch for each of the four propellers on ferry 100 when ferry 100 is moving in reverse.

TABLE 2

Rate and Direction of Rotation and Pitch for Propellers When Moving In Reverse.

| Propeller | Rate and Direction of Rotation | Pitch |
|---|---|---|
| 213-1-1 | $-\omega_S$ | $\phi_T$ |
| 213-1-2 | $+\omega_S$ | $\phi_L$ |
| 213-2-1 | $+\omega_P$ | $\phi_T$ |
| 213-2-2 | $-\omega_P$ | $\phi_L$ |

In some alternative embodiments of the present invention, the watercraft only moves in one direction, rather than in both forwards and reverse. In theses cases, each of propellers 213-1-1, 213-2-1, 213-1-2, and 213-2-2 can be a fixed-pitch propeller, wherein the pitch of the leading propeller is fixed at (DL and the pitch of the trailing propeller is fixed at $\phi_T$.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. A watercraft comprising:

a first hull that is buoyant in water;

a second hull that is buoyant in water;

a third hull that is buoyant in water;

a fourth hull that is buoyant in water;

a first propeller shaft that extends from a first end of said first hull towards said second hull, wherein said first end of said first hull is the only end of said first hull from which any propeller shaft extends;

a second propeller shaft that extends from a first end of said second hull towards said first hull, wherein said first end of said second hull is the only end of said second hull from which any propeller shaft extends;

a third propeller shaft that extends from said a first end of said third hull towards said fourth hull, wherein said first end of said third hull is the only end of said third hull from which any propeller shaft extends;

a fourth propeller shaft that extends from a first end of said fourth hull towards said third hull, wherein said first end of said fourth hull is the only end of said fourth hull from which any propeller shaft extends; and a superstructure connected to said first hull, said second hull, said third hull, and said fourth hull;

wherein said first hull, said second hull, said third hull, and said fourth hull provide substantially all of the buoyancy of said watercraft.

2. The watercraft of claim 1 further comprising:

a first propeller on said first propeller shaft;

a first engine within said first hull for turning said first propeller;

a second propeller on said second propeller shaft;

a second engine within said second hull for turning said second propeller;

a third propeller on said third propeller shaft;

a third engine within said third hull for turning said third propeller;

a fourth propeller on said fourth propeller shaft; and a fourth engine within said fourth hull for turning said fourth propeller.

3. The watercraft of claim 1 wherein when said watercraft is moving forward:

the rate of rotation of said first propeller is $+\omega$ and the pitch of said first propeller is $\phi_L$, the rate of rotation of said second propeller is $-\omega$ and the pitch of said second propeller is $\phi_T$, the rate of rotation of said third propeller is $-\omega$ and the pitch of said third propeller is $\phi_L$, and the rate of rotation of said fourth propeller is $+\omega$ and the pitch of said fourth propeller is $\phi_T$.

4. The watercraft of claim 1 wherein said first propeller shaft is collinear with said second propeller shaft; and wherein said third propeller shaft is collinear with said fourth propeller shaft.

5. The watercraft of claim 1 further comprising:

a first variable-pitch propeller on said first propeller shaft;

a second variable-pitch propeller on said second propeller shaft;

a third variable-pitch propeller on said third propeller shaft; and a fourth variable-pitch propeller on said fourth propeller shaft;

wherein the pitch $\phi$ of said first propeller at the rate of rotation of $\omega$ equals the pitch $\phi$ of said second propeller when the rate of rotation of said second propeller is $\omega$; and wherein the pitch $\phi$ of said third propeller at the rate of rotation of $\omega$ equals the pitch $\phi$ of said fourth propeller when the rate of rotation of said fourth propeller is $\omega$.

6. The watercraft of claim 5 wherein the rate of rotation of said first propeller is $+\omega$ when the rate of rotation of said second propeller is $-\omega$.

7. The watercraft of claim 5 wherein said first propeller shaft is collinear with said second propeller shaft;

wherein said third propeller shaft is collinear with said fourth propeller shaft; and wherein said first propeller shaft is parallel to said third propeller shaft.

8. A watercraft comprising:

a first hull that is buoyant in water;

a second hull that is buoyant in water;

a third hull that is buoyant in water;

a fourth hull that is buoyant in water;

a first propeller shaft that extends from said first hull towards said second hull, wherein said first propeller shaft is the sole propeller shaft that extends from said first hull;

a second propeller shaft that extends from said second hull towards said first hull, wherein said second propeller shaft is the sole propeller shaft that extends from said second hull;

a third propeller shaft that extends from said third hull towards said fourth hull, wherein said third propeller shaft is the sole propeller shaft that extends from said third hull;

a fourth propeller shaft that extends from said fourth hull towards said third hull, wherein said fourth propeller shaft is the sole propeller shaft that extends from said fourth hull; and a superstructure connected to said first hull, said second hull, said third hull, and said fourth hull;

wherein said first hull, said second hull, said third hull, and said fourth hull provide substantially all of the buoyancy of said watercraft.

* * * * *